US012055370B2

(12) United States Patent
Nesterenko

(10) Patent No.: US 12,055,370 B2
(45) Date of Patent: Aug. 6, 2024

(54) NON-LETHAL PROJECTILE

(71) Applicants: Andrii Viktorovych Nesterenko, Kiev (UA); Maksym Hennadiyovych Levchuk, Kremenchuk (UA)

(72) Inventor: Andrii Viktorovych Nesterenko, Kiev (UA)

(73) Assignee: Maksym Hennadiyovych Levchuk, Kremenchuk (UA)

( * ) Notice: Subject to any disclaimer, the term of this patent is extended or adjusted under 35 U.S.C. 154(b) by 0 days.

(21) Appl. No.: 17/787,621

(22) PCT Filed: May 27, 2020

(86) PCT No.: PCT/UA2020/000057
§ 371 (c)(1),
(2) Date: Jun. 21, 2022

(87) PCT Pub. No.: WO2021/126136
PCT Pub. Date: Jun. 24, 2021

(65) Prior Publication Data

US 2022/0412705 A1 Dec. 29, 2022

(30) Foreign Application Priority Data

Dec. 20, 2019 (UA) ..... a201912077

(51) Int. Cl.
*F42B 10/48* (2006.01)
*F42B 10/14* (2006.01)

(52) U.S. Cl.
CPC ..... *F42B 10/48* (2013.01); *F42B 10/14* (2013.01)

(58) Field of Classification Search
CPC ..... F42B 10/48; F42B 10/14
(Continued)

(56) References Cited

U.S. PATENT DOCUMENTS 3,952,662 A * 4/1976 Greenlees ..... F42B 7/10 102/400
7,549,376 B1 * 6/2009 Grossman ..... F42B 12/34 102/446

(Continued)

FOREIGN PATENT DOCUMENTS

FR 3041744 A1 * 3/2017 ..... F42B 10/14

OTHER PUBLICATIONS

International Search Report dated Sep. 17, 2020 for International Application No. PCT/UA2020/000057.

(Continued)

*Primary Examiner* — Samir Abdosh
(74) *Attorney, Agent, or Firm* — JCIP; Joseph G. Chu; Jeremy I. Maynard

(57) ABSTRACT

A non-lethal projectile comprises a rear portion in the form of a cylinder (2) coupled to at least two symmetrical petal-like impact elements (1) which are capable of opening upon leaving a bore and are designed to form, in a closed configuration, a cylinder having an outside diameter equal to the diameter of the cylindrical rear portion and also having an axial cylindrical opening which transitions into an axial opening in the cylindrical rear portion of the projectile. The petal-like elements have an asymmetrical cross section and an inner conical groove, the base of which is disposed at the rear portion-end of the projectile, wherein, in the front portion, each petal-like element has a unidirectional relief.

1 Claim, 1 Drawing Sheet

Figure 1:
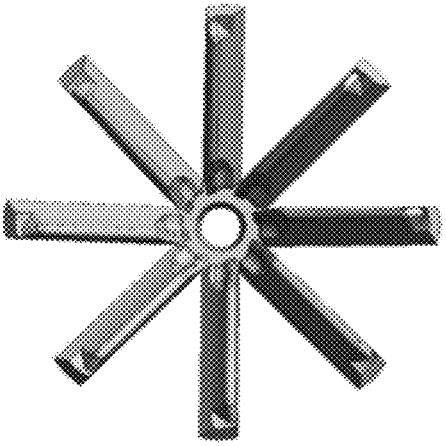

(58) Field of Classification Search
USPC ..... 102/502
See application file for complete search history.

(56) References Cited

U.S. PATENT DOCUMENTS

| | | | | |
|---|---|---|---|---|
| 9,797,696 | B2 * | 10/2017 | Golloher | F42B 12/34 |
| 2007/0101892 | A1 | 5/2007 | Rastegar | |
| 2010/0095863 | A1 * | 4/2010 | Kolnik | F42B 14/064 102/502 |
| 2013/0042783 | A1 * | 2/2013 | Diller | F42B 12/38 102/513 |
| 2013/0055917 | A1 * | 3/2013 | Menefee, III | F42B 7/10 102/370 |
| 2015/0330751 | A1 * | 11/2015 | Flint | F42B 12/74 102/507 |
| 2015/0345919 | A1 * | 12/2015 | Leach | F42B 12/34 102/502 |

OTHER PUBLICATIONS

Written Opinion of International Searching Authority dated Sep. 17, 2020 for International Application No. PCT/UA2020/000057.

* cited by examiner

NON-LETHAL PROJECTILE

FIELD OF THE INVENTION

The invention relates to the production of ammunition with non-lethal projectiles for firearms and bladed weapons.

BACKGROUND OF THE INVENTION

Most often, the manufacturers of shock-traumatic cartridges use a cylindrical design (shape) of projectiles. The disadvantage of such designs is that the contact impact plane does not change until it is in direct contact with the object of interaction. The diameter of the projectile is limited by the diameter of the barrel of the weapon. That is why in such projectiles it is impossible to combine a high initial speed in the context of non-lethal action ammunition and a stopping action that would not exceed the health and life threatening action to an object. Furthermore, there are some restrictions related to the range of application that in some cases are physically or by situation impossible to comply with. The vast majority of traumatic projectiles allowed for civilian use have restrictions on use from 20 meters onwards, which is not, in fact, a self-defense distance.

Due to the increased contact area, the NASTAR projectile has a high frontal resistance to the air flow, which allows to reduce dramatically the speed of the bullet and, accordingly, the energy of the projectile to the permissible according to physiological and medical standards at high initial speed. This reduces the application distance to real distances (up to 10 meters).

In certain cases, if needed, this distance can be increased to the one required in accordance with the customer's demands.

Tests of cartridges to smooth-bore weapons equipped with NASTAR bullets prove this with practical results.

Also, some manufacturers use shells that exceed the diameter of the barrel, in the form of a ball or ball-shaped (oval), which limits the use of materials only to soft ones because of the need to squeeze a projectile in a shell that has certain geometric dimensions for normal functioning in the weapon. Soft non-lethal projectile material has low density and therefore low weight. As a consequence, this affects the speed, energy of the projectile, and the ability of cartridges with similar bullets to function in certain types of self-loading weapons.

The NASTAR non-lethal projectile can be made of materials of different hardness that are acceptable for use in corresponding types of weapons, including some types of self-loading ones.

Bullets (for firearms) according to U.S. Pat. No. 9,797,696B2, US20150330751A1 (USA) patents with predictable deformation and segmented elements are known. They have visually somewhat similar elements, but they are fundamentally different from the NAS TAR projectile both in tasks and in principle of operation. They are designed to inflict maximum target damage and unfold upon contact with the target.

The NASTAR non-lethal projectile is based on the principle of increasing the contact area by segmented impact elements which unfold in flight before contact with the target and prevent penetration into the target. There are no analogues of this design.

SUMMARY

The objective of non-lethal projectiles is to stop an object of attack (attacker) without causing significant damage while preventing the wounding incompatible with the life of any living organism, whether human or animal. Such projectiles (bullets) serve for self-defense or preventing actions that threaten the public or personal safety of citizens.

The contact area of the impact part of the projectile should be as large as possible to transmit maximum energy directed to stop the object of action, while avoiding penetration and serious injury to the external and internal organs of living organisms.

The NASTAR non-lethal projectile (bullet) works according to the principle of increasing the contact area with segmented impact elements that unfold in flight yet before contact with the target and prevent penetration into the target.

The NASTAR projectile represents an integral design that includes segmented elements (two or more) and a base in the form of a ring connecting these elements.

The segmented elements unfold immediately after leaving the barrel, increasing the contact area several times. In flight, the projectile is stabilized by the rotation created by the action of the flow of air that accumulates on the petals performed in the form of an aircraft propeller (airplane, etc.). At the bottom of the projectile (ring) there is a groove (opening) like in parachutes, which prevents the deployment or inversion in flight.

High frontal resistance to the air flow of the increased contact area of the NASTAR projectile allows to reduce dramatically the speed of the bullet and, accordingly, the energy of the projectile to acceptable parameters according to physiological and medical standards at high initial speed.

The material for the NASTAR projectile can be composite materials based on rubber or plastics, to which materials can be added to increase or, conversely, to reduce weight.

LIST OF DRAWINGS

FIG. 1 "NASTAR" projectile in a static (flying, deployed) state (top view).

Figure 2:
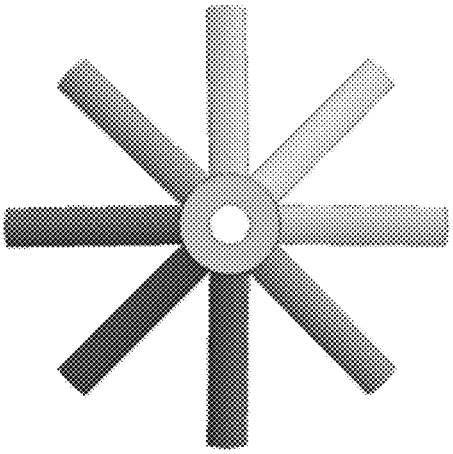

FIG. 2 "NASTAR" projectile in a static (flying, deployed) state (bottom view).

Figure 3:
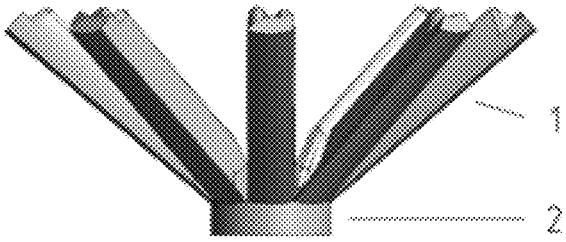

FIG. 3 "NASTAR" projectile in a static (flight, deployed) state (side view) with segmental contact-impact elements (1) connected to the connecting ring (2).

Figure 4:
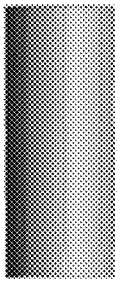

FIG. 4 "NASTAR" projectile in the folded state (side view).

Figure 5:
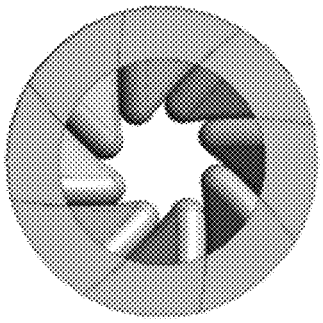

FIG. 5 "NASTAR" projectile in the folded state (top view).

Figure 6:
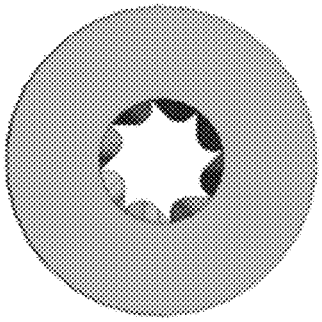

FIG. 6 "NASTAR" projectile in the folded state (bottom view).

The present invention is suitable for industrial production.

DETAILED DESCRIPTION

Embodiments of the present invention include a non-lethal projectile "NASTAR" comprising a rear portion made in the form of a cylinder coupled to at least two symmetrical petals having a cross section in the form of a circle sector whose outside diameter is equal to the diameter of the cylindrical rear portion, and in folded state forming a cylinder with a blind axial cylindrical opening, wherein the rear portion of the non-lethal projectile is in the form of a cylinder with an axial opening, and the petal-like elements have an asymmetrical section and in folded state form a cylinder and have an inner conical groove, the base of which is disposed at the rear portion-end of the non-lethal projectile, wherein, in the front portion, each petal-like element has a unidirectional relief.

The principle of operation of the "NASTAR" projectile consists in a special design that reveals several structural segments of the projectile connected by a connecting ring—impact elements in flight immediately after leaving the barrel (before contact with the target) increasing the contact area of the projectile several times. In flight, the projectile is stabilized by the rotation created by the action of the flow of air that accumulates on the petals performed in the form of an aircraft propeller (airplane, etc.). The frontal resistance to the air flow of the increased contact area of the projectile allows to reduce dramatically the speed of the bullet and, accordingly, the energy of the projectile to acceptable parameters according to physiological and medical standards at high initial speed. However, the distances of justified use of the projectile are significantly reduced, which is an important task for non-lethal ammunition.

The "NASTAR" projectile represents an integral design that includes segmented elements (two or more) and a base in the form of a ring connecting these elements.

Further embodiments include a non-lethal projectile comprises a rear portion in the form of a cylinder (2) coupled to at least two symmetrical petal-like impact elements (1) which are capable of opening upon leaving a bore and are designed to form, in a closed configuration, a cylinder having an outside diameter equal to the diameter of the cylindrical rear portion and also having an axial cylindrical opening which transitions into an axial opening in the cylindrical rear portion of the projectile. The petal-like elements have an asymmetrical cross section and an inner conical groove, the base of which is disposed at the rear portion-end of the projectile, wherein, in the front portion, each petal-like element has a unidirectional relief Embodiments of the present invention include a non-lethal projectile "NASTAR" comprising a rear portion made in the form of a cylinder coupled to at least two symmetrical petals having a cross section in the form of a circle sector whose outside diameter is equal to the diameter of the cylindrical rear portion, and in folded state forming a cylinder with a blind axial cylindrical opening, characterized in that the rear portion of the projectile is in the form of a cylinder with an axial opening, and the petal-like elements have an asymmetrical section and in folded state form a cylinder and have an inner conical groove, the base of which is disposed at the rear portion-end of the projectile, wherein, in the front portion, each petal-like element has a unidirectional relief.

The invention claimed is:

1. A non-lethal projectile "NASTAR" comprising a rear portion made in the form of a cylinder coupled to at least two symmetrical petal-like elements having a cross section in the form of a circle sector whose outside diameter is equal to the diameter of the cylindrical rear portion, and in folded state forming a cylinder with a blind axial cylindrical opening, characterized in that the rear portion of the projectile is in the form of a cylinder with an axial opening, and the petal-like elements have an asymmetrical section and in folded state form a cylinder and have an inner conical groove, wherein each petal-like element comprises a base disposed at the cylindrical rear portion-end of the projectile, and wherein, each petal-like element comprises a front portion having a unidirectional relief.

* * * * *